US006236160B1

(12) United States Patent
Komaki et al.

(10) Patent No.: US 6,236,160 B1
(45) Date of Patent: May 22, 2001

(54) PLASMA DISPLAY PANEL WITH FIRST AND SECOND RIBS STRUCTURE

(75) Inventors: Toshihiro Komaki; Hitoshi Taniguchi; Tatsuro Sakai, all of Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/335,904

(22) Filed: Jun. 18, 1999

(30) Foreign Application Priority Data

Jun. 22, 1998 (JP) ..... 10-191085
Mar. 4, 1999 (JP) ..... 11-057696

(51) Int. Cl.[7] ..... H01J 17/49
(52) U.S. Cl. ..... 313/586; 313/582
(58) Field of Search ..... 313/582, 584, 313/586, 605, 609, 238, 250, 252, 258, 268

(56) References Cited

U.S. PATENT DOCUMENTS 5,889,365 * 3/1999 Tanabe ..... 313/582

* cited by examiner

*Primary Examiner*—Vip Patel
(74) *Attorney, Agent, or Firm*—Sughrue, Mion, Zinn, Macpeak & Seas, PLLC

(57) ABSTRACT

In a plasma display panel, studs or second ribs are provided on the inner surface of a back side substrate. Each stud faces an edge portion of the associated one of projecting portions of the associated one of pairs of row electrodes far from a discharge gap therebetween and faces the associated one of body portions of the associated pair of row electrodes in the vicinity of the associated projecting portion. The studs are designed to be in contact with the dielectric layer.

6 Claims, 7 Drawing Sheets

PLASMA DISPLAY PANEL WITH FIRST AND SECOND RIBS STRUCTURE

BACKGROUND OF THE INVENTION

1. Field of the Invention

The present invention relates to a plasma display panel (also designated as a PDP hereinafter), and particularly to an AC driven PDP of surface discharge type which is driven with AC signals.

2. Description of Related Art

In recent years, the AC driven PDPs of surface discharge type have been expected as a large and thin color display apparatus.

FIG. 6 shows a cross-sectional view of one example of the structure of an AC driven PDP of surface discharge type.

Referring to FIG. 6, two pairs or more of row electrodes X and Y are laid on a glass substrate 21 to be a display screen side, the row electrodes extending in parallel to each other. The row electrodes X and Y are covered with a dielectric layer 24. Each of the row electrodes X and Y is comprised of a transparent electrode 23*a* formed of a transparent conductive film, and a metal electrode 23*b* of a metal film formed on the electrode 23*a* in order to supplement the conductivity of the transparent conductive film with the metal film. The metal electrodes 23*b* are stacked on the ends portion of the transparent conductive films 23*a* opposite to a discharge gap G respectively.

The dielectric layer 24 is comprised of a first dielectric layer 24*a* which uniformly covers up the inner surface of the glass substrate 21 and the row electrodes X and Y, and a second dielectric layer 24*b*, i.e., a raising dielectric layer which formed on the first dielectric layer 24*a* at the corresponding portion to the metal electrode 23*b*. The second dielectric layer 24*b* causes the surface of the dielectric layer 24 to locally rise at the corresponding portion to the metal electrode 23*b*. Since the second dielectric layer 24*b* is formed with approximately the same width as that of the metal electrode 23*b* and in parallel to the metal film and locally forms a slightly elevated bank on the surface of the dielectric layer 24, the layer 24*b* restricts spreading of discharge, thereby preventing adjoining discharge cells from erroneously discharging. A protection layer 25 of MgO is formed on this dielectric layer 24.

On the other hand, a plurality of column electrodes 26 are formed on the inner surface of a glass substrate 22 to be a back side in parallel to one another at predetermined intervals therebetween, and a fluorescent layer 27 is formed on the column electrodes 26 and the inner surface of a glass substrate 22.

The glass substrate 21 of the display screen side and the glass substrate 22 of the back side are secured apart from each other in such a manner that the row electrodes X and Y perpendicularly cross the column electrodes 26 in order to define a discharge space 28 between the inner surfaces of the substrates facing each other. The discharge space 28 is filled with a rare gas, and the assembled panel is sealed hermetically.

Ribs or partitions (not shown) having a predetermined height are formed between the column electrodes 26 on the back-side glass substrate 22 respectively to separate the column electrodes 26 and the plural pairs of row electrodes X and Y, thereby defining a unit of light-emitting regions having light-emitting surfaces with a predetermined area.

The dielectric layer 24 is formed by coating a low-melting point glass paste containing, for example, lead oxide (PbO) on the row electrodes X and Y and annealing it. Since the metal film needs to have a low electric resistance in order to supplement the conductivity of the transparent conductive film, Al (aluminum), Al alloy, Ag (silver), Ag alloy or the like is used for the metal film.

SUMMARY OF THE INVENTION

Since the raising dielectric layer mentioned above is formed by a screen printing, its precision in the height and positioning accuracy are insufficient. Such low precisions in manufacture result in giving an insufficient demonstration of the effect of the raising dielectric layer 24*b* to restrict a size of discharge spreading and prevent interference of discharge between adjoining cells.

Accordingly, the present invention is made to overcome the aforementioned problems and it is an object of the present invention to provide a plasma display panel which is capable of preventing the discharge interference and ensuring a stable function of displaying an image.

The aforementioned problems are overcome and advantages are provided by a plasma display panel according to the present invention which comprises:

a pair of first and second substrates facing each other spaced with a discharge space, which are on a display-screen side and on a back side respectively;

a plurality of pairs of row electrodes extending horizontally and arranged on an inner surface of the first substrate as corresponding to display-lines respectively, each of said paired row electrodes comprised of a main body portion extending horizontally and projecting portions each projecting from the main body portion toward the other row electrode in the pair in a manner that fellow front ends of the paired projecting portions face each other through a discharge gap;

a dielectric layer formed on said row electrodes;

a plurality of column electrodes extending vertically and arranged on an inner surface of said second substrate, each of said plurality of column electrodes associated with each of the row electrodes and defining a unit region of light-emission including the discharge gap and an intersection formed wherever one of said column electrodes crosses apart from one of said pair of row electrodes in said discharge space;

a plurality of first ribs extending vertically and disposed between said column electrodes to separate said discharge space for each of said unit regions of light-emission;

fluorescent layers covering up at least said column electrodes, and a plurality of second ribs provided on said inner surface of said second substrate, each second ribs facing an opposite edge portion of said projecting portion to said discharge gap and a portion of the main body portion of the row electrode in vicinity of said opposite edge, and said second ribs being in contact with said dielectric layer.

According to this plasma display panel, the second ribs i.e., studs, each facing the opposite edge portion of the associated one of the projecting portions of the associated pair of row electrodes to the discharge gap and the body portion in the vicinity of the associated projecting portion, are provided on the inner surface of the back side substrate, and the studs are designed to be in contact with the dielectric layer. This structure therefore restricts discharge spreading toward adjoining unit regions of light-emission.

In a plasma display panel according to one embodiment in a first aspect of the present invention, the first and second ribs may be formed of a glass layer patterned by sandblasting, thereby improving the height and positional precisions.

In another plasma display panel according to one embodiment in a second aspect of the present invention, the fluorescent layer may be so provided as to cover the column electrodes, sides of the partitions of first ribs and sides of the studs of second rib, thereby increasing the area of the fluorescent layer in each unit region of light-emission.

In a further plasma display panel according to one embodiment in a third aspect of the present invention, a light-shielding layer may be provided on the inner surface of the first substrate and between adjoining pairs of row electrodes to improve the contrast for each unit region of light-emission.

In a still further plasma display panel according to one in a fourth aspect of the present invention, the occupying ratio of the fluorescent layer that contributes to light emission can be increased significantly by allowing at least one of the body portions of each pair of row electrodes to be shared by adjoining display-lines.

BRIEF DESCRIPTION OF THE DRAWINGS

The aforementioned aspects and other features of the invention are explained in the following description, taken in connection with the accompanying drawing figures wherein.

DETAILED DESCRIPTION OF THE PREFERRED EMBODIMENTS

For a better understanding of the invention reference is made to the following detailed description of the preferred embodiments.

Figure 1:
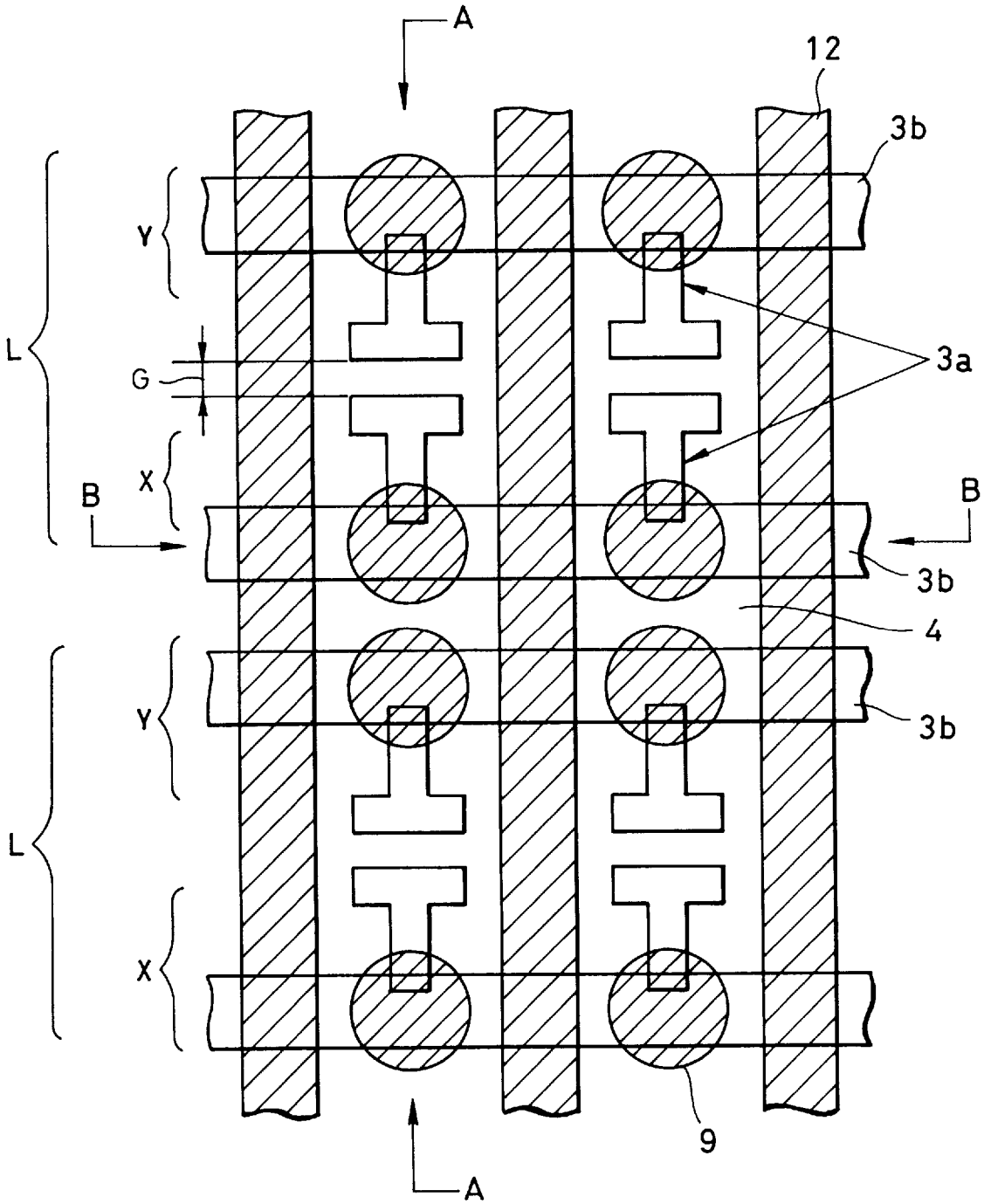
FIG. 1 is a plan view for explaining a surface discharge type PDP according to a first embodiment of the present invention.
Figure 2:
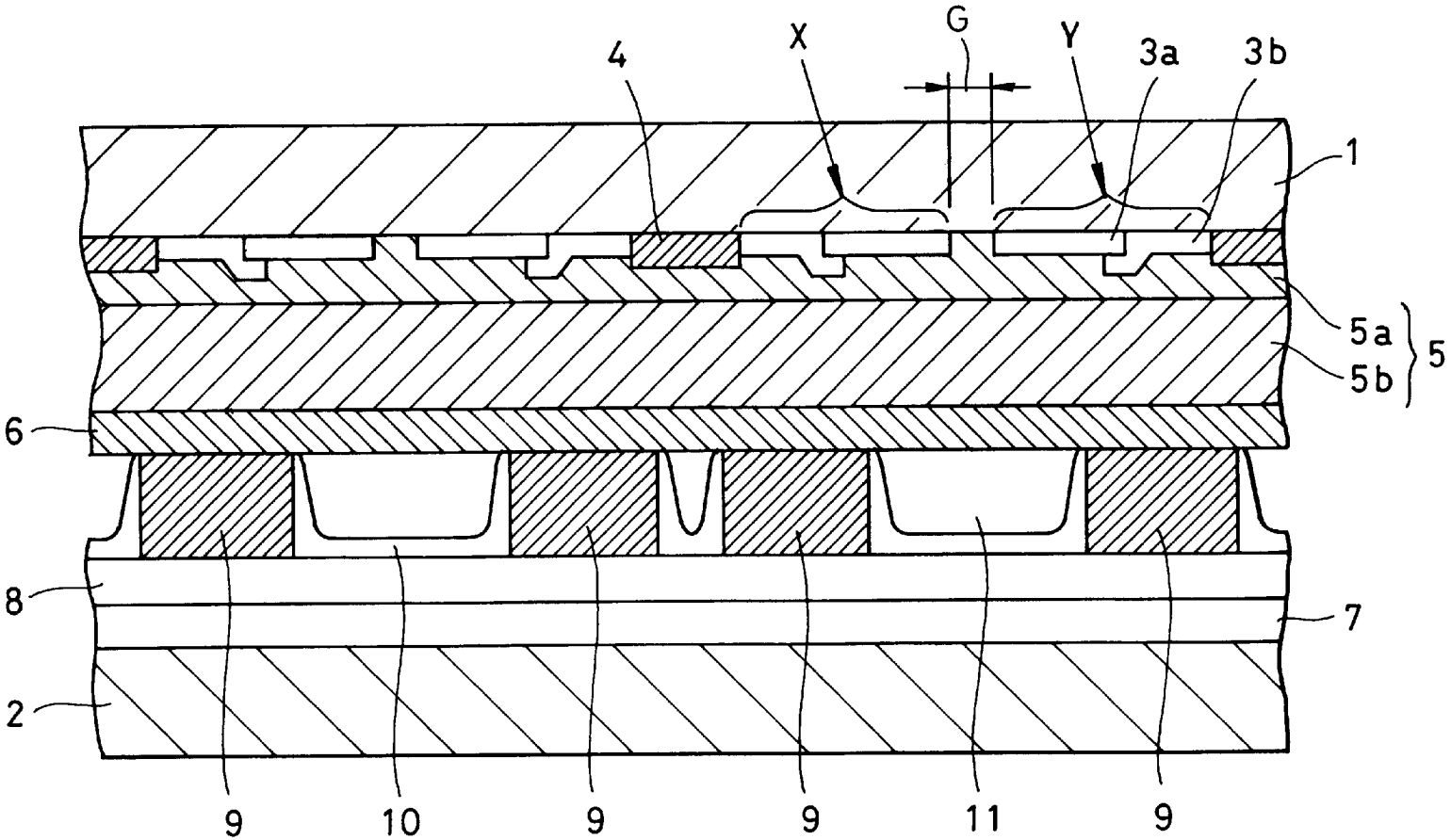
FIG. 2 is a cross-sectional view taken along the line A—A in FIG. 1.
Figure 3:
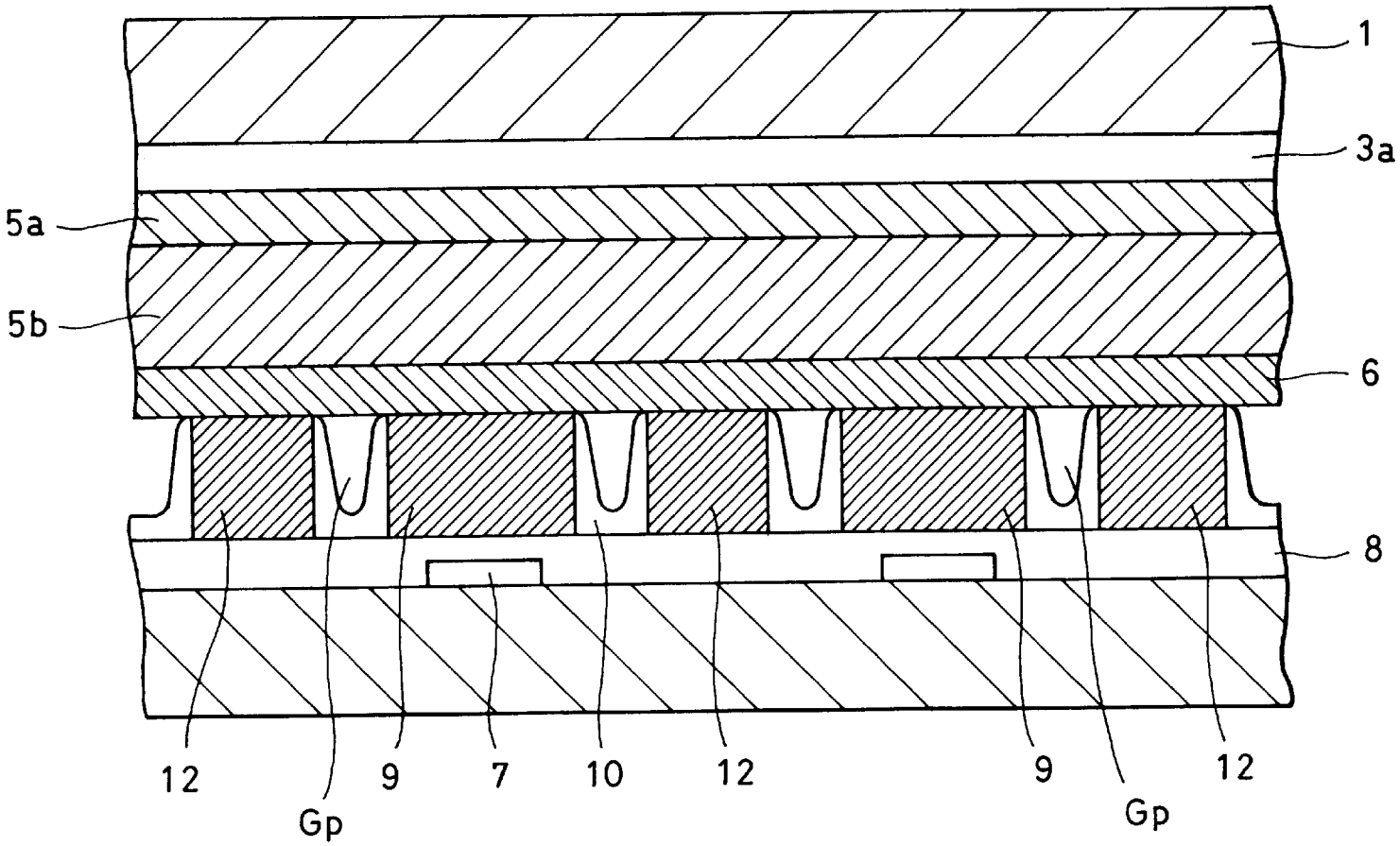
FIG. 3 is a cross-sectional view taken along the line B—B in FIG. 1.

FIG. 1 is a plan view for explaining a surface discharge type PDP according to a first embodiment of the present invention, and FIG. 2 is a cross-sectional view of the surface discharge type PDP view taken along the line A—A in FIG. 1. FIG. 3 is a cross-sectional view taken along the line B—B in FIG. 1.

The structure of the PDP of a first embodiment will be described below with reference to FIGS. 1 through 3.

As shown in FIGS. 2 and 3, plural pairs of row electrodes X and Y are laid in parallel on a glass substrate 1 on the display screen side. As shown in FIG. 1, one pair of row electrodes X and Y form a display-line L. Each of the row electrodes X and Y extending horizontally is comprised of a T-shaped projecting portion 3*a*, i.e., transparent electrode and a metal electrode 3*b* of a main body portion which is formed of a metal film. Each projecting portion 3*a* projects from the main body portion 3*b* in a direction intersecting with the extending direction of the main body portion toward the other row electrode on the glass substrate 1. The adjacent projecting portions 3*a* are paired. Thus, the paired projecting portions of the paired row electrodes project such that their front ends face each other through a predetermined gap G. The predetermined gap G serves as a discharge gap per a unit of light-emitting region. Preferably, the projecting portion 3*a* projects perpendicular to the horizontal direction in which the main body portion 3*b* extends. The T-shaped projecting portion 3*a* of the row electrode is formed with a wider portion including the front end and a narrower portion which joins wider portion with the main body 3*b* and has a width smaller than the width of the front end. The metal electrode 3*b* is partially stacked on the base end portion of the T-shaped projecting portion 3*a* in order to supplement the conductivity of the transparent electrode.

Light-shielding layers 4, i.e., black material layers are formed between adjoining display-lines L, i.e., paired row electrodes X and Y on the glass substrate 1. In other wards, black pigment layers are formed on regions of non-display-lines surrounded by the metal electrodes 3*b* of adjoining display-lines.

A dielectric layer 5, which is comprised of a first dielectric layer 5*a* and a second dielectric layer 5*b*, is so formed as to cover the row electrodes X and Y. A protection layer 6 of MgO is formed on this dielectric layer 5.

On the other hand, a plurality of column electrodes 7 are formed on the inner surface of a glass substrate 2 on the back side in parallel to one another at predetermined intervals therebetween as shown in FIGS. 2 and 3. An electrode protection layer or white dielectric layer 8 is so formed as to cover the column electrodes 7. Columnar studs 9 or second ribs each having a predetermined height are formed on the electrode protection layer 8 at positions wherever each of studs faces the opposite edge portion of the T-shaped projecting portion to the discharge gap G, i.e., the base of the projecting portion of the associated pair of row electrodes and a portion of the main body of the row electrode in the vicinity of the associated projecting portion. In other words, the second ribs 9 are intermittently arranged with the main body 3*b* of the metal electrode. The electrode protection layer 8 and the sides of columnar studs 9 are covered with a fluorescent layer 10. The studs 9 are in contact with the dielectric layer 5 via the protection layer 6.

Ribs or partitions 12 or first ribs each having a predetermined height are formed between the column electrodes 7 on the inner surface of the back-side glass substrate 2 to respectively separate the plural pairs of row electrodes X and Y and the column electrodes 7, thereby defining unit regions of light-emission having light-emitting surfaces of a predetermined area. The sides of the ribs or partitions 12 are also covered with the fluorescent layer 10.

The glass substrate 1 on the display screen side and the glass substrate 2 on the back side are set apart from each other in such a way that the plural paired row electrodes X and Y perpendicularly cross the column electrodes 7, thereby defining a discharge space 11 between the inner surfaces of the substrates facing each other. The discharge space 11 is filled with a rare gas, and the assembled panel is sealed hermetically.

Figure 6:
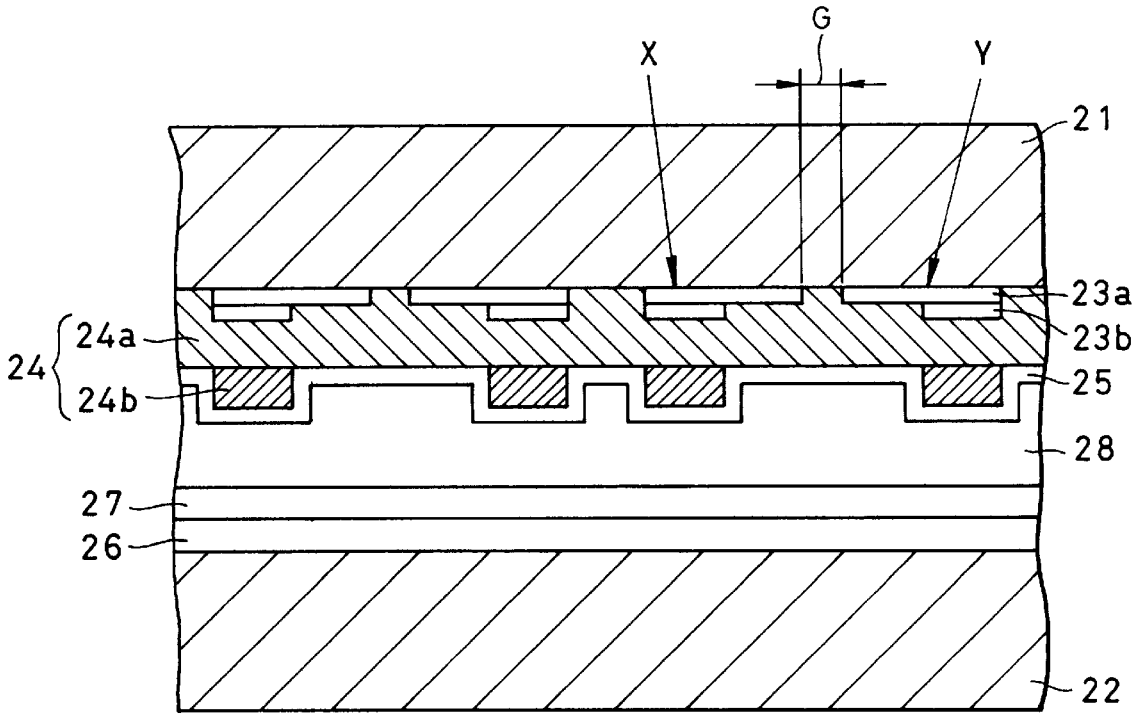
FIG. 6 is a cross-sectional view of a conventional surface discharge type PDP.

As apparent from the above description, the difference between the PDP illustrated in FIGS. 1 to 3 and the conventional PDP shown in FIG. 6 lies in that the studs 9 are provided on the inner surface of the back side glass substrate 2, and the studs 9 are made in contact with the dielectric layer 5 via the protection layer 6 in such a manner that each stud protrudes and faces an opposite edge portion of the projecting portion to the discharge gap and a portion of the main body portion of the row in the vicinity of the opposite edge.

This structure can restrict discharge spreading toward adjoining discharge cells. It is also possible to increase the area of the fluorescent layer 10 in each unit region of light-emission.

It is to be noted that the studs 9 are so formed as to provide a predetermined gap Gp between each stud and its associated partition 12. Such gaps Gp can ensure movement of priming particles (charge particles, exciting particles) in the discharge space to the adjoining discharge cells, thus facilitating the occurrence of discharging.

The thus constituted surface discharge type PDP of the present invention is manufactured by steps that will be discussed below.

(1) First, a transparent conductive film of ITO, tin oxide or the like is vapor-deposited on a surface of the glass substrate 1 on the display screen side to be an inner surface thereof. Then, ITO film is patterned into an array of T-shaped projecting portions of electrodes 3*a* in a manner that the fellow front ends of wider portions of adjacent projecting portions to be paired face each other through the discharge gap G, for the respective unit regions of light-emission. After that, the metal electrodes 3*b* is patterned and formed through a vapor-deposition of a metal film of metal like Al (aluminum), Al alloy, Ag (silver) or Ag alloy by using a predetermined mask so that each opposite edge portion of the projecting portion to the discharge gap is covered with and electrically connected to the metal electrode, and in obtaining the plural paired row electrodes 3*a* and 3*b* extending parallel to each other as shown in FIG. 1.

(2) Next, a black pigment layer 4 is formed on the inner surface of the glass substrate 1 on the display-screen side and between the adjoining row electrodes X and Y belonging to different paired row electrodes X and Y. In this way, the light-shielding layer (black layer) 4 is formed.

(3) The inner surface of the glass substrate 1 is uniformly coated with a glass paste which essentially consists of a first glass material having a softening point of 580° C. or above (e.g., 580° C.) in such a manner as to cover the thus formed row electrodes X and Y each comprised of the transparent electrode 3*a* and the metal electrode 3*b*. And then, the glass substrate 1 is annealed at a temperature near the softening point (560° C. to 600° C.), thereby forming the first dielectric layer 5*a* to be a base layer.

(4) The first dielectric layer 5*a* is uniformly coated with a second glass material whose softening point (460° C. to 480° C.) is sufficiently lower than that of the first glass material. And then, the glass substrate 1 is annealed at a temperature (560° C. to 600° C.) sufficiently higher than its softening point, thereby forming the second dielectric layer 5*b*.

To anneal the glass substrate 1 at such a temperature sufficiently higher than the softening point can enhance the transmittance of the second dielectric layer 5*b*.

(5) The protection layer 6 of magnesium oxide (MgO) is vapor-deposited on the second dielectric layer 5*b* at a thickness of about several thousands angstroms. In this way, an assembly for the glass substrate 1 on the display-screen side is complete.

(6) Next, the plural column electrodes 7 extending parallel to each other are formed on a surface of the glass substrate 2 on the back side to be an inner surface thereof by a vapor-deposition of a metal film of metal like Al (aluminum), Al alloy, Ag (silver) or Ag alloy by using a predetermined mask.

(7) The surface carrying the column electrodes 7 of the back side glass substrate 2 is uniformly coated with a glass paste at a predetermined thickness. And then, the glass substrate 2 is annealed, thereby forming the electrode protection layer 8.

(8) The electrode protection layer 8 is uniformly coated with a glass paste at a predetermined thickness. And then, the glass substrate 2 is annealed, thereby forming a glass layer for the partitions and studs. This glass layer is then dug by sandblasting through the patterned apertures of a sandblast mask, thereby forming the ribs or partitions 12 and studs 9 having the predetermined height into predetermined patterns as shown in FIG. 1.

(9) A fluorescent paste is screen-printed on the surface carrying the ribs or partitions 12 and studs 9 of the glass substrate 2 in such a way as that recesses among the partitions 12 and studs 9 are substantially fill with the fluorescent materials, and then the fluorescent paste is annealed, thereby forming the fluorescent layer 10 so as to cover the surfaces of the column electrodes 7 and the side surfaces of the partitions 12 and studs 9. In realizing color display on the plasma display panel, fluorescent layers of three colors of red R, green G and blue B are formed in order for each of the column electrodes. In this way, an assembly for the glass substrate 2 on the back side is complete.

(10) The display-screen side glass substrate 1 and the back side glass substrate 2 are put gather and sealed so that the fellow carrying sides of the row electrodes X and Y and the column electrodes 7 of both the substrates face each other in such a manner that the row electrode and the column electrodes are extended perpendicular to each other, resulting that the partitions 12 and studs 9 are in contact with the dielectric layer 6. The gap, i.e., discharge space 11 between the assembled substrates is degassed. After that the surface of the protection layer 6 is rendered active by baking. Then, a rare gas, for example, inactive mixed gas containing 1 to 10% of xenon (Xe) is introduced into the discharge space 11 under a pressure of 200 to 600 torr and the discharge space 11 is sealed.

Through the above process, a matrix of pixel cells each emitting light is formed in which each pixel cell includes a unit region of light-emission about its center at the intersection of the paired row electrodes X and Y and the column electrodes 7 formed in the discharge space 11. In a case of implementing a color display on the plasma display panel, each pixel cell emits lights of the colors that correspond to the three colors of the fluorescent substances.

In the plasma display panel constructed in the above described manner, various pulse voltages are applied to the row electrodes X and Y for controlling to initiate the light emission the pixel cells, to sustain the light emission and the light-off action, while image data pulses are applied to the column electrodes 7 for the individual pixel cells, so that the initiation of light emission of the pixel cells, the sustaining of light emission and the light-off are carried out.

Figure 4:
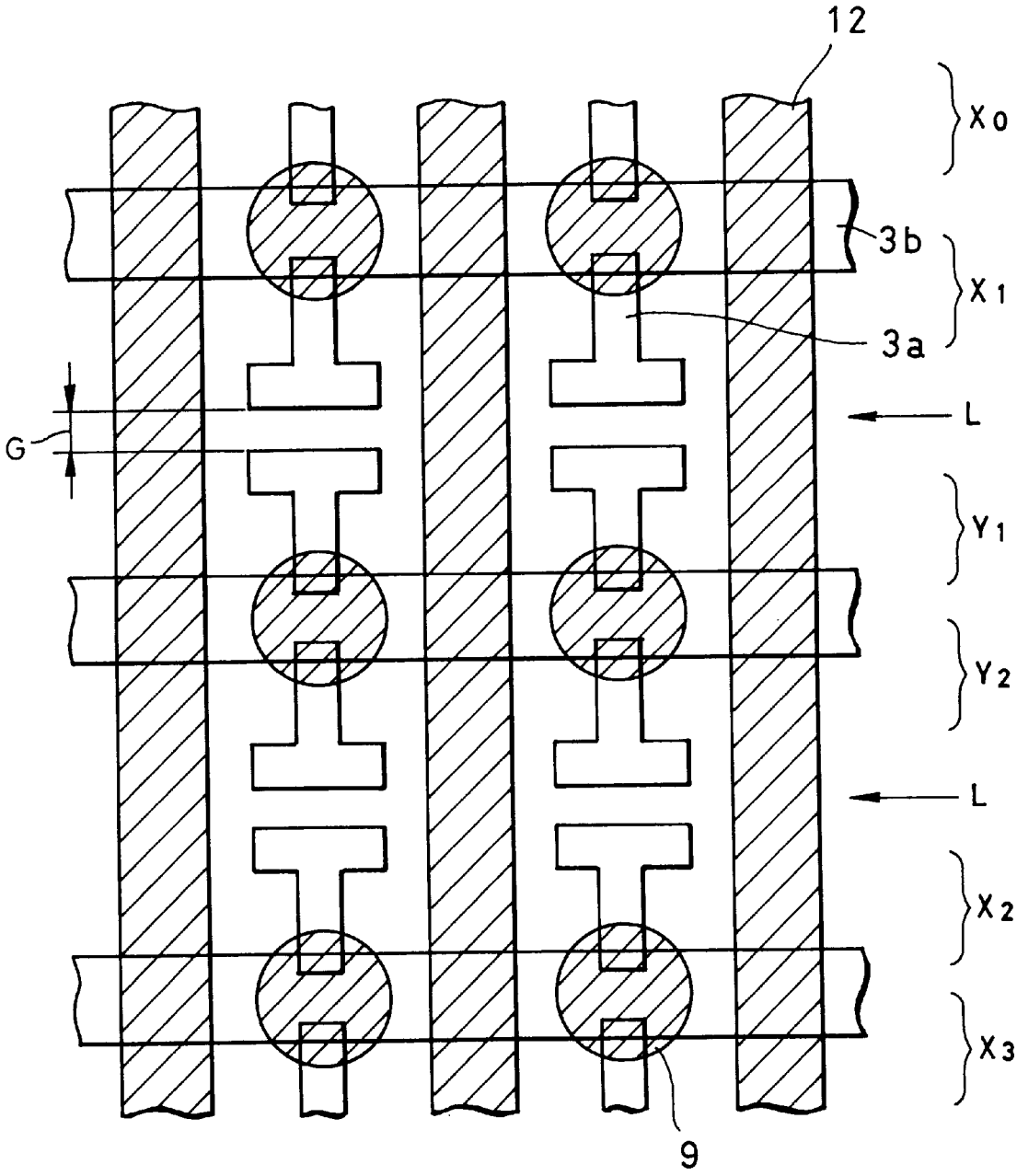
FIG. 4 is a plan view for explaining a surface discharge type PDP according to a second embodiment of the present invention.
Figure 7:
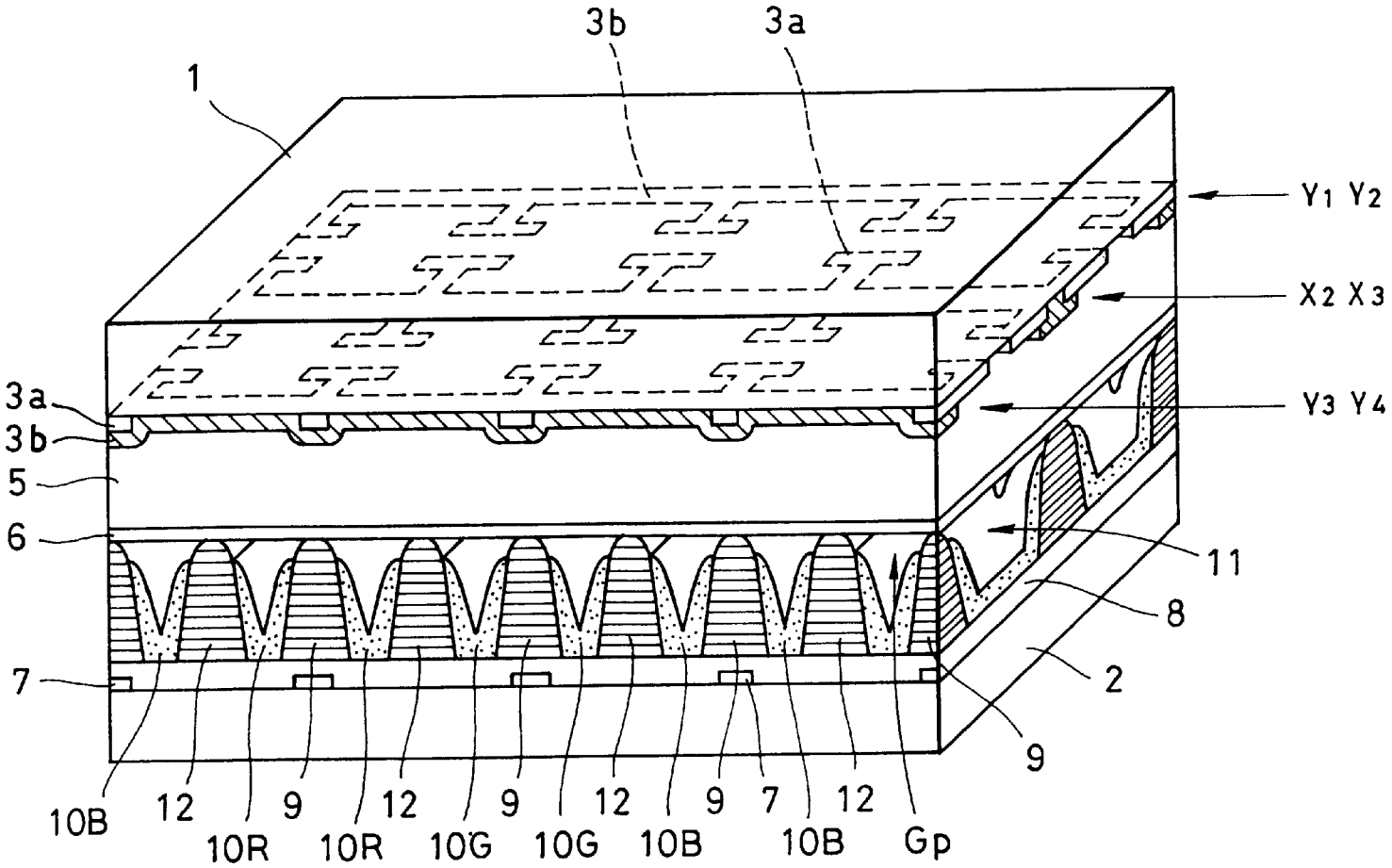
FIG. 7 is a perspective view of a surface discharge type PDP according to a second embodiment of the present invention.

FIG. 4 is a plan view of surface discharge type PDP according to a second embodiment of the present invention, and FIG. 7 is a perspective view of the same, exemplarily illustrating the relationship among the pairs of row electrodes X and Y, the partitions and the projecting portions.

The second embodiment differs from the first embodiment in that, as shown in FIG. 4, the row electrodes X and Y are so arranged as to alternately change the positions thereof line by line L, and in that the adjoining row electrodes $X_{i-1}$ and $X_i$ as well as $Y_i$ and $Y_{i+1}$ are commonly integrated for the adjoining display-lines L, so that the metal electrode or body portion 3*b* is shared by those adjoining display-lines L. FIG. 4 shows three metal body portion 3*b* integrated respectively for the adjoining row electrodes $X_0$ and $X_1$, $Y_1$ and $Y_2$, and $X_2$ and $X_3$. This structure can considerably increase the occupying ratio of the fluorescent layer 10 that contributes to improvement of light emission.

Figure 5:
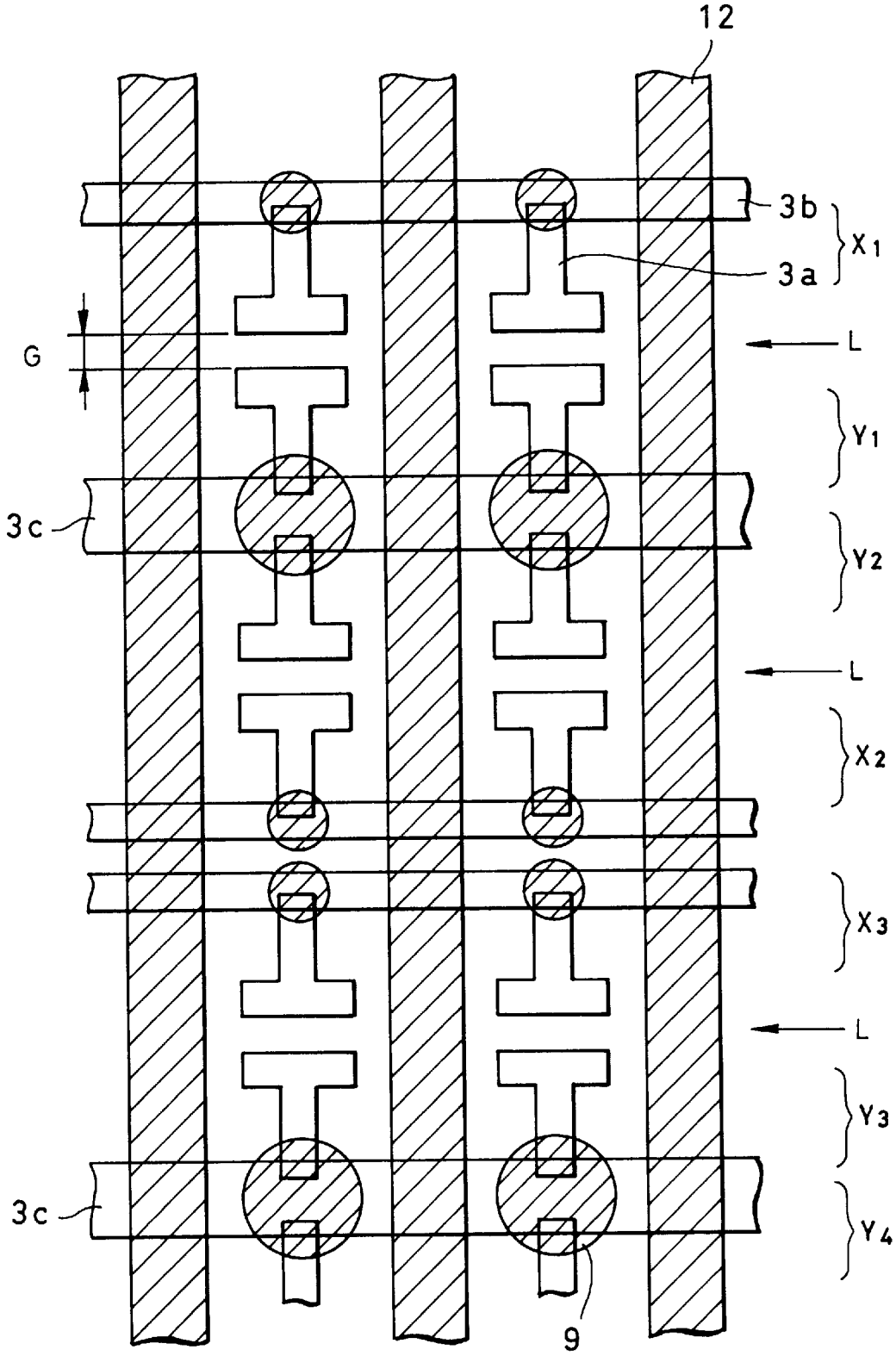
FIG. 5 is a plan view for explaining a surface discharge type PDP according to a third embodiment of the present invention.

FIG. 5 is a plan view of surface discharge type PDP according to a third embodiment of the present invention, exemplarily illustrating the relationship among the pairs of row electrodes X and Y, the partitions and the projecting portions.

The third embodiment differs from the first embodiment in that, as apparent from FIG. 5, the row electrodes X and Y are laid as to alternately change the positions thereof line by line L, and in that the row electrodes $Y_i$ and $Y_{i+1}$ are commonly integrated for adjoining display-lines L, and the metal electrode (body portion) 3*b* is shared by those adjoining display-lines L, while $X_i$ and $X_{i+1}$ are arranged independently. That is, this embodiment is constructed in such a way that the row electrodes X and Y are so arranged as to alternately change the positions themselves line by line L, and the body portions of one type of row electrodes to which the same drive signal is supplied (e.g., the row electrodes X) are commonly integrated for the adjoining display-lines L. FIG. 5 shows two metal body portion 3*c* integrated respectively for the adjoining row electrodes $Y_1$, and $Y_2$ and $Y_3$ and $Y_4$, and the row electrodes $X_2$ and $X_3$ are arranged independently. This structure can considerably increase the occupying ratio of the fluorescent layer 10 that contributes to improvement of light emission.

What is claimed is:

1. A plasma display panel comprising:

a pair of first and second substrates facing each other and spaced with a discharge space, which are on a display-screen side and on a back side respectively;

a plurality of pairs of row electrodes extending horizontally and arranged on an inner surface of the first substrate as corresponding to display-lines respectively, each of said paired row electrodes comprised of a main body portion extending horizontally and projecting portions each projecting from the main body portion toward the other row electrode in the pair in a manner that fellow front ends of the paired projecting portions face each other through a discharge gap;

a dielectric layer formed on said row electrodes;

a plurality of column electrodes extending vertically and arranged on an inner surface of said second substrate, each of said plurality of column electrodes associated with each of the row electrodes and defining a unit region of light-emission including the discharge gap and an intersection formed wherever one of said column electrodes crosses apart from one of said pair of row electrodes in said discharge space;

a plurality of first ribs extending vertically and disposed between said column electrodes to separate said discharge space for each of said unit regions of light-emission;

fluorescent layers covering up at least said column electrodes, and a plurality of second ribs provided on said inner surface said second substrate, each second ribs facing an opposite edge portion of said projecting portion to said discharge gap and a portion of the main body portion of the row electrode in the vicinity of said opposite edge, and said second ribs being in contact with said dielectric layer.

2. A plasma display panel according to claim 1, wherein said first and second ribs are formed of a glass layer patterned in a sandblast process.

3. A plasma display panel according to claim 1, wherein said fluorescent layer is so provided as to cover sides of said first and second ribs together with said column electrodes.

4. A plasma display panel according to claim 1, wherein a light-shielding layer is provided on the inner surface of said first substrate and between adjoining pairs of row electrodes.

5. A plasma display panel according to claim 1, wherein at least one of the paired row electrodes is shared by an adjoining display-line.

6. A plasma display panel according to claim 1, wherein said second ribs are so formed as to provide a predetermined gap between each second rib and its associated first rib.

* * * * *